US010018099B2

(12) United States Patent
Nakashima

(10) Patent No.: US 10,018,099 B2
(45) Date of Patent: Jul. 10, 2018

(54) ENGINE COOLING SYSTEM

(71) Applicant: MAZDA MOTOR CORPORATION, Hiroshima (JP)

(72) Inventor: Jun Nakashima, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 182 days.

(21) Appl. No.: 14/982,483

(22) Filed: Dec. 29, 2015

(65) Prior Publication Data

US 2016/0195000 A1 Jul. 7, 2016

(30) Foreign Application Priority Data

Jan. 7, 2015 (JP) ..... 2015-001669

(51) Int. Cl.
*F01P 3/02* (2006.01)
*F01P 7/14* (2006.01)

(52) U.S. Cl.
CPC ..... *F01P 3/02* (2013.01); *F01P 2003/027* (2013.01); *F01P 2007/143* (2013.01)

(58) Field of Classification Search
CPC ..... F01P 3/02; F01P 2003/028; F02F 1/14
See application file for complete search history.

(56) References Cited

U.S. PATENT DOCUMENTS

| | | | | |
|---|---|---|---|---|
| 8,171,896 | B2 | 5/2012 | Hanai et al. | |
| 2003/0111025 | A1* | 6/2003 | Kim | F01P 7/16 123/41.72 |
| 2009/0266315 | A1* | 10/2009 | Hanai | F02F 1/14 123/41.72 |
| 2015/0377114 | A1 | 12/2015 | Matsumoto et al. | |

FOREIGN PATENT DOCUMENTS

| | | | |
|---|---|---|---|
| DE | 112014000931 | T5 | 11/2015 |
| EP | 0466551 | A1 | 1/1992 |
| FR | 2879260 | A1 | 6/2006 |
| JP | 2009-97352 | A | 5/2009 |
| JP | 4547017 | B2 | 9/2010 |

* cited by examiner

*Primary Examiner* — Jacob Amick
*Assistant Examiner* — Charles Brauch
(74) *Attorney, Agent, or Firm* — Studebaker & Brackett PC

(57) ABSTRACT

A cooling system for an engine includes a block-side water jacket divided into a block cooling passage and a bypass passage in the circumferential direction of the block-side water jacket, the block cooling passage allowing a cooling liquid introduced into the block cooling passage to flow into the head-side water jacket via a first communication hole of a cylinder head, and the bypass passage allowing the cooling liquid to bypass the block cooling passage and flow into the head-side water jacket via a second communication hole of the cylinder head. The cooling system further includes a partition separating a downstream end of the block cooling passage and the bypass passage from each other in the circumferential direction. The partition is provided with an adjustment hole which makes a flow of part of the cooling liquid passing through the bypass passage directed to the first communication hole.

3 Claims, 8 Drawing Sheets

ENGINE COOLING SYSTEM

CROSS-REFERENCE TO RELATED APPLICATION

This application claims priority to Japanese Patent Application No. 2015-001669 filed on Jan. 7, 2015, the disclosure of which including the specification, the drawings, and the claims is hereby incorporated by reference in its entirety.

BACKGROUND

The present disclosure relates to an engine cooling system.

A conventionally known engine cooling system includes a water jacket (hereinafter referred to as "block-side water jacket") provided in a cylinder block of an engine and surrounding a plurality of cylinders, and another water jacket (hereinafter referred to as "head-side water jacket") provided in a cylinder head of the engine (see, e.g., Japanese Unexamined Patent Application Publication No. 2009-97352). Japanese Unexamined Patent Application Publication No. 2009-97352 discloses a system including two leading passages. Specifically, one of the leading passages leads a cooling liquid, that has been introduced from a water pump into the block-side water jacket through a cooling-liquid introducing passage, out of the block-side water jacket to allow the cooling liquid to flow into the head-side water jacket. The other leading passage leads the cooling liquid from the water pump such that the cooling liquid bypasses the block-side water jacket and directly flows into the head-side water jacket. When the temperature of the cooling liquid is low, as in a cold state of the engine (during warm-up of the engine), the cooling liquid from the water pump is not guided into the block-side water jacket, but is directly guided into the head-side water jacket by bypassing the block-side water jacket. This accelerates warm-up of the engine.

Japanese Patent No. 4547017 discloses disposing a water jacket spacer in a block-side water jacket, and providing the water jacket spacer with a regulation wall located close to a cooling-liquid introduction port of a cylinder block to regulate the cooling liquid flowing from the cooling-liquid introduction port to the head-side water jacket.

SUMMARY

If two passages are provided as leading passages to allow a cooling liquid to flow into a head-side water jacket, as disclosed in Japanese Unexamined Patent Application Publication No. 2009-97352, the surface of a cylinder head facing a cylinder block is provided with a first communication hole for allowing the cooling liquid that has flowed around a plurality of cylinders to flow from a block-side water jacket into a head-side water jacket, and a second communication hole for allowing the cooling liquid to bypass the block-side water jacket and flow into the head-side water jacket. In a cold state of the engine, the cooling liquid flows in the head-side water jacket via only the second communication hole, and in a warm state of the engine, the cooling liquid flows in the head-side water jacket via the first and second communication holes.

However, the cooling liquid is not allowed to flow around the cylinders in the cold state of the engine, and thus, no cooling liquid flows from the first communication hole into the head-side water jacket. Thus, the cooling liquid that has flowed into the head-side water jacket via the second communication hole, due to momentum of the flow, may flow out of the first communication hole into the block-side water jacket.

In view of the foregoing, it is an object of the present disclosure to, when no cooling-liquid flows around one or more cylinders surrounded by a block-side water jacket, prevent a cooling liquid which has flowed into a head-side water jacket via a second communication hole from flowing into the block-side water jacket via a first communication hole which allows the cooling liquid that has flowed around the cylinders to flow into the head-side water jacket.

In order to attain the above object, the following engine cooling system is provided.

The engine cooling system includes: a block-side water jacket provided in a cylinder block of an engine and surrounding one or more cylinders; and a head-side water jacket provided in a cylinder head of the engine, wherein the cooling system is configured to supply a cooling liquid from a water pump to the block-side water jacket and the head-side water jacket through a cooling-liquid introducing passage, one end of the cylinder head is provided with first and second communication holes aligned in a circumferential direction of the block-side water jacket and allowing the block-side water jacket and the head-side water jacket to communicate with each other, the block-side water jacket is divided into a block cooling passage and a bypass passage in the circumferential direction of the block-side water jacket, the block cooling passage introducing the cooling liquid from the cooling-liquid introducing passage to allow the cooling liquid to flow in the block cooling passage such that the cooling liquid substantially circles around the cylinders, and then, allowing the cooling liquid to flow into the head-side water jacket via the first communication hole, and the bypass passage allowing the cooling liquid from the cooling-liquid introducing passage to bypass the block cooling passage and to flow into the head-side water jacket via the second communication hole, the engine cooling system further includes a partition provided in the block-side water jacket at a portion between the first and second communication holes, and separating a downstream end of the block cooling passage and the bypass passage from each other in the circumferential direction of the block-side water jacket, and the partition is provided with an adjustment hole which makes a flow of part of the cooling liquid passing through the bypass passage directed to the first communication hole.

According to the above configuration, even if no cooling liquid flows in the block cooling passage as in the cold state of the engine, part of the cooling liquid that has passed through the bypass passage is directed to the first communication hole after passing through the adjustment hole to flow into the head-side water jacket via the first communication hole. As a result, this allows for preventing the cooling liquid that has flowed into the head-side water jacket via the second communication hole from the bypass passage from flowing into the block-side water jacket (the block cooling passage) via the first communication hole. This thus allows for effectively accelerating warm-up of the engine. The flow of the cooling liquid flowing into the head-side water jacket through the adjustment hole and the first communication hole is relatively strong. Thus, when the cooling liquid flows in the block cooling passage as in the warm state of the engine, the cooling liquid that has flowed in the block cooling passage is sucked into this flow, and flows into the head-side water jacket via the first communication hole. This accelerates the inflow of the cooling liquid from the block cooling passage into the head-side water jacket.

The engine cooling system preferably further includes a separating wall provided at a boundary between an upstream end of the block cooling passage and the bypass passage in the block-side water jacket, and allowing the cooling liquid flowing from the cooling-liquid introducing passage to flow into the block cooling passage and the bypass passage.

This allows the cooling liquid that flowed into the block cooling passage from the cooling-liquid introducing passage to flow in the block cooling passage without flowing into the bypass passage, and allows the cooling liquid that flowed into the bypass passage flowing from the cooling-liquid introducing passage to flow in the bypass passage without flowing into the block cooling passage. As a result, in a cold state of the engine, this reliably prevents the cooling liquid from flowing into the block cooling passage, and prevents the cooling liquid that has flowed into the head-side water jacket via the second communication hole from flowing into the block-side water jacket via the first communication hole while effectively accelerating warm-up of the engine.

In the configuration of including the separating wall, a water jacket spacer is preferably further disposed inside the block-side water jacket, and the partition provided with the adjustment hole and the separating wall are formed in the water jacket spacer.

This water jacket spacer thus allows for easily providing the partition and the separating wall.

The water jacket spacer is preferably provided with a cooling passage forming portion, which forms the block cooling passage, between the cylinders and the water jacket spacer at at least a portion closer to the cylinder head, and an introduction opening allowing the cooling-liquid introducing passage to communicate with the block cooling passage.

This cooling passage forming portion allows for, in a warm state of the engine, effectively cooling a portion of the cylinder, the portion being closer to the cylinder head, being to reach a high temperature, and corresponding to a combustion chamber.

DETAILED DESCRIPTION

An example embodiment of the present disclosure will now be described in detail with reference to the accompanying drawings.

Figure 1:
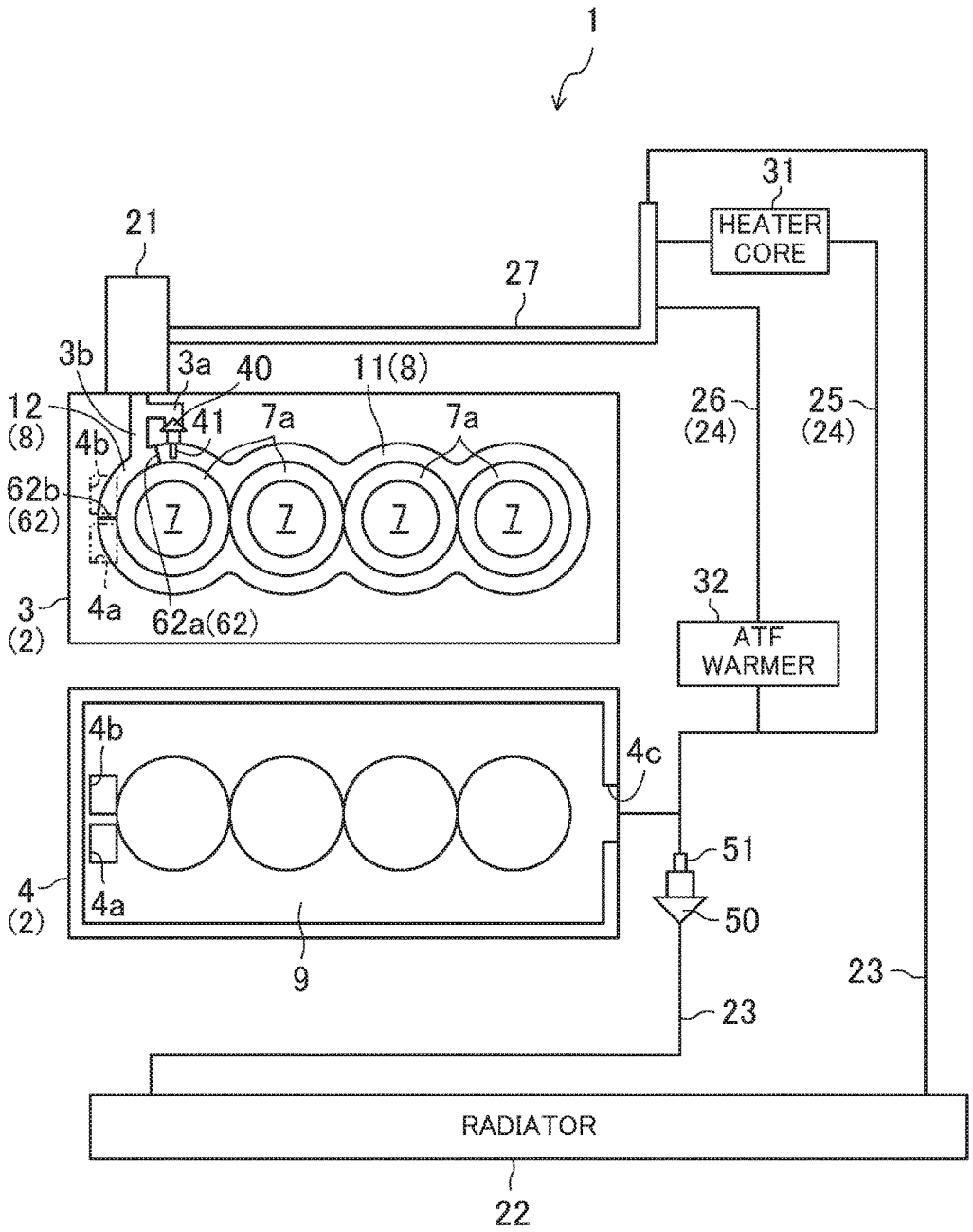
FIG. 1 is a schematic view illustrating the configuration of a cooling system for an engine according to an example embodiment.

FIG. 1 schematically illustrates the configuration of a cooling system 1 for an engine 2 according to the example embodiment. In this example embodiment, the engine 2 is an in-line four-cylinder engine, and this four-cylinder engine is mounted at the front of the vehicle in a transverse direction such that the direction of the line of the four-cylinder (i.e., the direction in which the crankshaft extends) coincides with the vehicle width direction. This engine 2 (an engine body) includes a cylinder block 3 having four cylinders 7, and a cylinder head 4 disposed above the cylinder block 3.

The cylinder block 3 and the cylinder head 4 are respectively provided with a block-side water jacket 8 and a head-side water jacket 9 each through of which a cooling liquid flows. The block-side water jacket 8 surrounds the four cylinders 7 (specifically, four cylinder bore walls 7*a*). The block-side water jacket 8 is divided into a block cooling passage 11 and a bypass passage 12 in its circumferential direction, and a partition is provided between the block cooling passage 11 and the bypass passage 12 as described below. The block cooling passage 11 substantially surrounds or circles around the four cylinders 7 (the four cylinder bore wall 7*a*). The bypass passage 12 is disposed at a portion of the block-side water jacket 8 in its circumferential direction, that is, at the end portion of one side (the vehicle's right side in this example embodiment (in the left side in FIG. 1)) of the cylinder-line direction. The head-side water jacket 9 extends in the cylinder-line direction of the cylinder head 4 so as to cover suction and discharge ports and a plug hole of each cylinder. The number of the cylinders 7 is not limited to four. It may be one or a plural number other than four.

The cooling system 1 includes: the block-side water jacket 8, a cooling-liquid introducing passage 3*a* provided in the cylinder block 3 and introducing a cooling liquid from a water pump 21, which is driven in conjunction with the crankshaft of the engine 2, into the block-side water jacket 8 (specifically, the block cooling passage 11); and a first thermostatic valve 40 provided in the cooling-liquid introduction passage 3*a*, and opened or closed according to the temperature of the cooling liquid contacting a temperature sensing element 41.

The water pump 21 is fixed to a surface of the cylinder block 3 facing the rear side of the vehicle at the end portion of the one side of the cylinder-line direction. The cooling liquid from the water pump 21 is introduced into the block-side water jacket 8 (specifically, the block cooling passage 11) through the cooling-liquid introducing passage 3*a*. This cooling-liquid introducing passage 3*a* is disposed at the cylinder block 3 at a location corresponding to the vehicle's rear side of one of the four cylinders 7 which is closest to the one side (vehicle's right side).

The first thermostatic valve 40 is a wax pellet thermostatic valve which is closed when the temperature of the cooling liquid contacting the temperature sensing element 41 filled with wax serving as a thermal expansion body is lower than a first predetermined temperature, and is opened when the temperature of the cooling liquid is equal to or more than the first predetermined temperature. When the first thermostatic valve 40 is opened, the cooling liquid from the water pump 21 is introduced into the block cooling passage 11 through the cooling-liquid introducing passage 3*a*.

A first inlet 4*a* and a second inlet 4*b* are formed in the lower surface (specifically, comprised of gasket) of the cylinder head 4 at the end portion of the one side of the cylinder-line direction. Specifically, the first inlet 4*a* leads the cooling liquid out of the block cooling passage 11 into the head-side water jacket 9 (allows the cooling liquid to flow in the head-side water jacket 9). The second inlet 4*b* leads the cooling liquid out of the bypass passage 12 into the head-side water jacket 9 (allows the cooling liquid to flow in the head-side water jacket 9). The first and second inlets 4*a* and 4*b* are formed in the lower surface of the cylinder head 4 so as to be aligned in the circumferential direction of the block-side water jacket 8. The first and second inlets 4*a* and 4*b* respectively correspond to first and second communication holes allowing the block-side and head-side water jackets 8 and 9 to communicate with each other. In the end of the wall of the cylinder head 4 at the other side of the cylinder-line direction (the wall on the vehicle's left side in this example embodiment (the right side in FIG. 1)), an outlet 4*c* is formed to allow the cooling liquid to flow out of the head-side water jacket 9.

In the cylinder block 3, a branch passage 3*b* is branched from a portion of the cooling-liquid introducing passage 3*a* upstream of the first thermostatic valve 40 (a portion between the water pump 21 and the first thermostatic valve 40). This branch passage 3*b* communicates with the bypass passage 12, and together with this bypass passage 12, allows the cooling liquid from the water pump 21 to bypass the block cooling passage 11 and allow the cooling liquid to flow into the head-side water jacket 9. The cooling-liquid introducing passage 3*a* and the branch passage 3*b* can be considered as a cooling-liquid introducing passage, and the cooling liquid from the water pump 21 is supplied to the block-side and head-side water jackets 8 and 9 through this cooling-liquid introducing passage.

When the first thermostatic valve 40 is opened, the cooling liquid from the water pump 21 is introduced into the block cooling passage 11 through the cooling-liquid introducing passage 3*a*. This cooling liquid that has been introduced flows in the block cooling passage 11 so as to substantially circle around the cylinders, and then, flows in the head-side water jacket 9 via the first inlet 4*a*. Part of the cooling liquid that has been introduced into the block cooling passage 11 also comes from an inlet hole (not illustrated) formed in the lower surface of the cylinder head 4 between adjacent cylinders 7 to flow in the head-side water jacket 9.

When the first thermostatic valve 40 is opened, the cooling liquid from the water pump 21 passes through the branch passage 3*b* and the bypass passage 12 to flow into the head-side water jacket 9 via the second inlet 4*b*.

On the other hand, when the first thermostatic valve 40 is closed, the cooling-liquid from the water pump 21 passes through the branch passage 3*b* and the bypass passage 12 to flow into the head-side water jacket 9 via the second inlet 4*b*. However, the cooling liquid is not introduced into the block cooling passage 11. Thus, no cooling liquid is introduced into the head-side water jacket 9 from the block cooling passage 11 via the first inlet 4*a*.

The cooling liquid that has been introduced into the head-side water jacket 9 flows through the cylinder head 4 from the one side to the other side in the cylinder-line direction, and flows out of the cylinder head 4 via the outlet 4*c*. This outlet 4*c* is connected to a radiator passage 23 and a radiator bypass passage 24. The radiator passage 23 allows the cooling liquid that has flowed from the outlet 4*c* to flow into (returns to) the water pump 21 via a radiator 22 disposed at the front end of the vehicle. The radiator bypass passage 24 allows the cooling liquid to bypass the radiator 22 and flow into (return to) the water pump 21.

The radiator bypass passage 24 is provided with a heat exchanger other than the radiator 22. In the example embodiment, the heat exchanger other than the radiator 22 is configured as a heater core 31 of an air conditioner disposed in an instrument panel in the interior of the passenger compartment of the vehicle, and an automatic transmission fluid (ATF) warmer 32 warming lubricating oil for the automatic transmission coupled to the crankshaft of the engine 2. The radiator bypass passage 24 is comprised of a passage 25, a passage 26, the passages 25 and 26 being branched from each other, and a return passage 27 connected not only to the passage 25 and 26 but also to the water pump 21.

The radiator passage 23 is also connected to the return passage 27, thereby allowing the cooling liquid that has exchanged heat with air outside the vehicle in the radiator 22 to pass through the return passage 27 and return to the water pump 21. The return passage 27 can also be considered as a part of the radiator passage 23 (The return passage 27 may functions as the radiator passage 23 and the radiator bypass passage 24.).

A second thermostatic valve 50 is provided at the radiator passage 23 near the outlet 4*c*, and is opened or closed according to the temperature of the cooling liquid contacting a temperature sensing element 51. This second thermostatic valve 50 is closed when the temperature of the cooling liquid contacting the temperature sensing element 51 (that is, the temperature of the cooling liquid immediately after the cooling liquid flows out of the outlet 4*c*) is lower than a second predetermined temperature, and is opened when the temperature is equal to or more than the second predetermined temperature. The second predetermined temperature is the minimum temperature (e.g., about 80° C.) at which the engine 2 is in a warm state and the cooling liquid that has flowed out of the outlet 4*c* has to pass through the radiator 22 to be cooled. The first predetermined temperature (e.g., about 60° C.) is lower than the second predetermined temperature, and is set such that, when the temperature of the cooling liquid contacting the temperature sensing element 41 reaches the first predetermined temperature from a temperature lower than the first predetermined temperature (when the first thermostatic valve 40 is just opened), the temperature of the cooling liquid contacting the temperature sensing element 51 (the temperature of the cooling liquid immediately after the cooling liquid flows out of the outlet 4*c*) does not reach the second predetermined temperature.

The configuration of the first thermostatic valve 40 and elements around the first thermostatic valve 40 will now be described in detail with reference to FIG. 2. The second thermostatic valve 50 has the same or similar configuration as/to the first thermostatic valve 40, and therefore, its detailed description will be omitted.

A pipe 28 functioning as the return passage 27 is connected to a suction port 21*a* of the water pump 21 (in FIG. 2 in which components inside the water pump 21 such as an impeller are not illustrated), and the upstream end of the cooling-liquid introducing passage 3*a* provided at the cylinder block 3 is connected to a discharge port 21*b* of the water pump 21. The downstream end of the cooling-liquid introducing passage 3*a* is connected to the block-side water jacket 8. The thermostatic valve 40 is disposed in the downstream side of the cooling-liquid introducing passage 3*a*. In the cylinder block 3, the branch passage 3*b* is branched from a portion closer to the upstream end of the cooling-liquid introducing passage 3*a*.

The thermostatic valve 40 has a valve seat member 43 having an opening 43*a* at the center thereof, and this valve seat member 43 is fixed to a step 39*b* formed in the internal circumferential surface of an opening 39*a* of a fixing plate 39 fixed to the cylinder block 3. This fixing plate 39 is covered with an introducing passage formation member 38 for forming the cooling-liquid introducing passage 3*a*. This introducing passage formation member 38 and the fixing plate 39 are fastened together to the surface of the cylinder block 3 facing the rear of the vehicle with a plurality of bolts 35 (only one bolt can be seen in FIG. 2).

The temperature sensing element 41 is disposed in the block-side water jacket 8 (specifically, in the block cooling passage 11) near the cylinder 7 (the cylinder bore wall 7*a*). The temperature sensing element 41 is supported by the valve seat member 43 through a plurality of coupling members (not illustrated) disposed radially outward from a compression coil spring 47, which will be described later.

The opening 43*a* is closed by attaching a valve body 44 on the valve seat member 43 from the upstream side. In this way, the thermostatic valve 40 is in a closed state. The valve body 44 is fixed to an end of a coupling shaft 45 extending from the temperature sensing element 41 passing through the opening 43*a*. This coupling shaft 45 is movable in the axis direction thereof depending on expansion or contraction of the wax. During the expansion of the wax, the coupling shaft 45 moves toward the upstream side, thereby allowing the valve body 44 to move toward the upstream side apart from the valve seat member 43. As a result, the thermostatic valve 40 is opened (FIG. 2 illustrates the opened state of the thermostatic valve 40.).

On the other hand, during the contraction of the wax, the coupling shaft 45 moves toward the downstream side, thereby attaching the valve body 44 on the valve seat member 43. As a result, the thermostatic valve 40 is closed. A spring-supporting member 46 is fixed to the coupling shaft 45, and the compression coil spring 47 is supported between the spring-supporting member 46 and the valve seat member 43. This compression coil spring 47 presses the valve body 44 onto the valve seat member 43. This allows for reliably maintaining the closed state of the valve 40.

Figure 2:
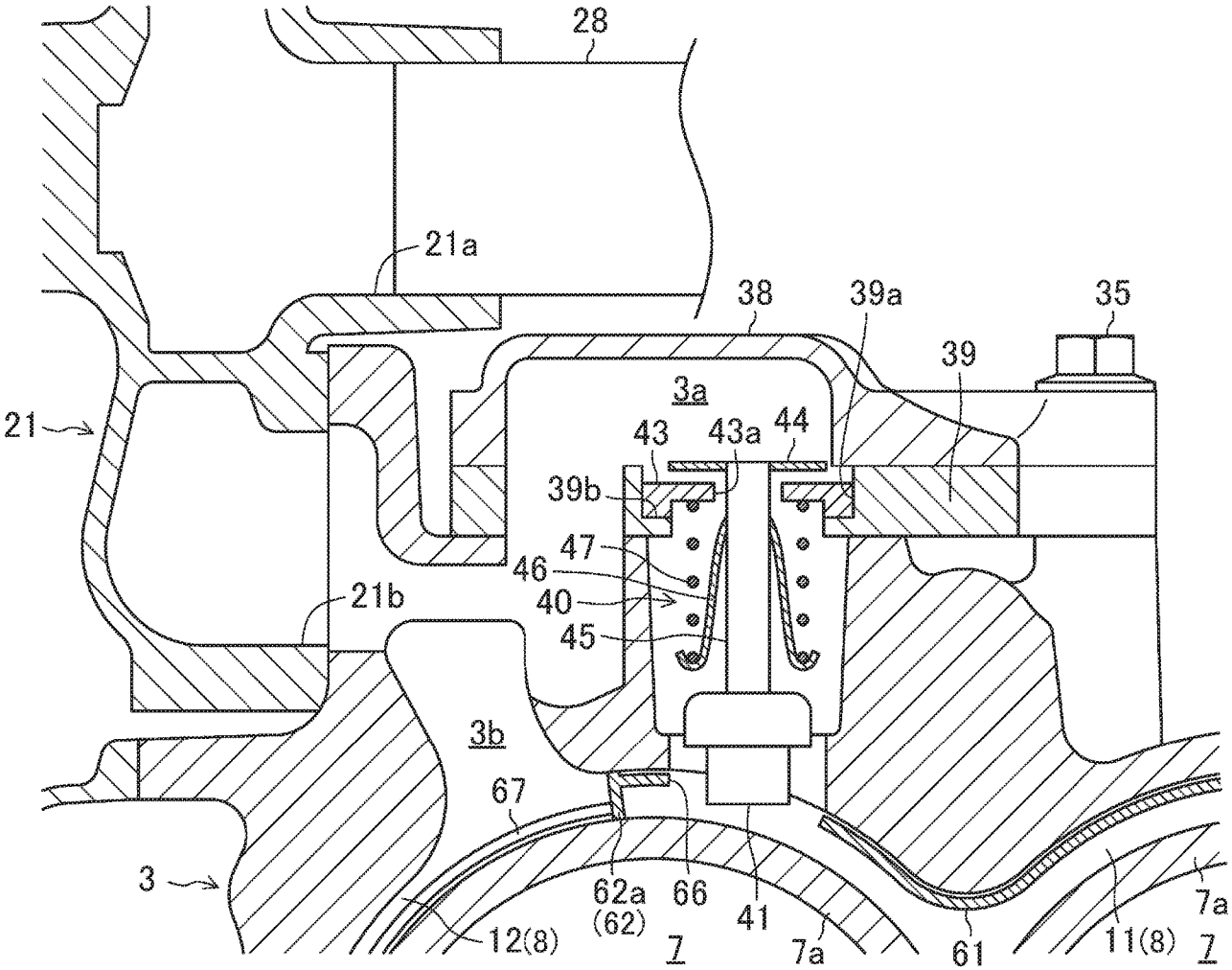
FIG. 2 is a cross-sectional view of a cylinder block taken in a direction perpendicular to an axis of a cylinder, and illustrates the configuration of a first thermostatic valve and elements around the first thermostatic valve.
Figure 3:
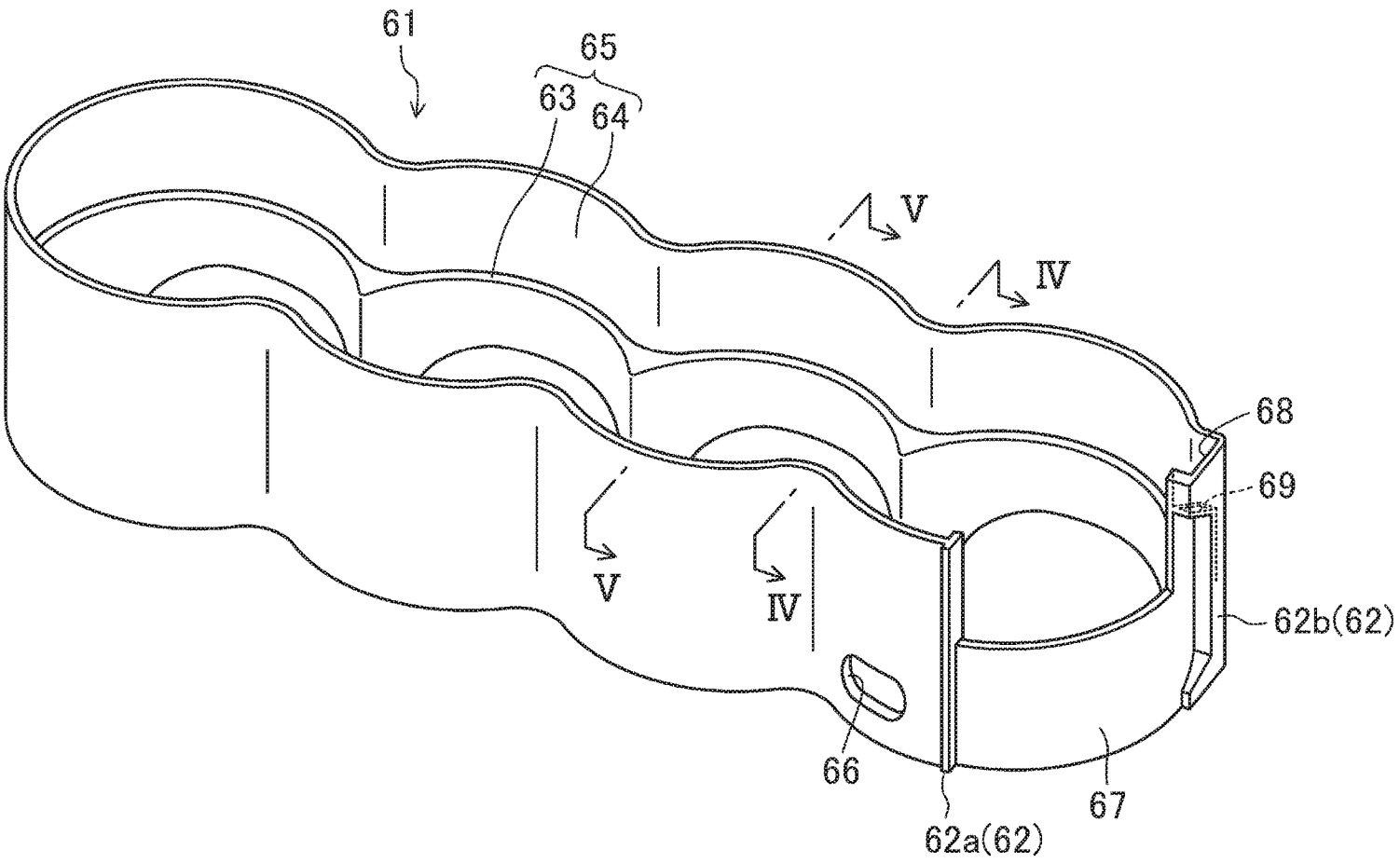
FIG. 3 is a perspective view illustrating a water jacket spacer disposed inside the block-side water jacket.
Figure 7:
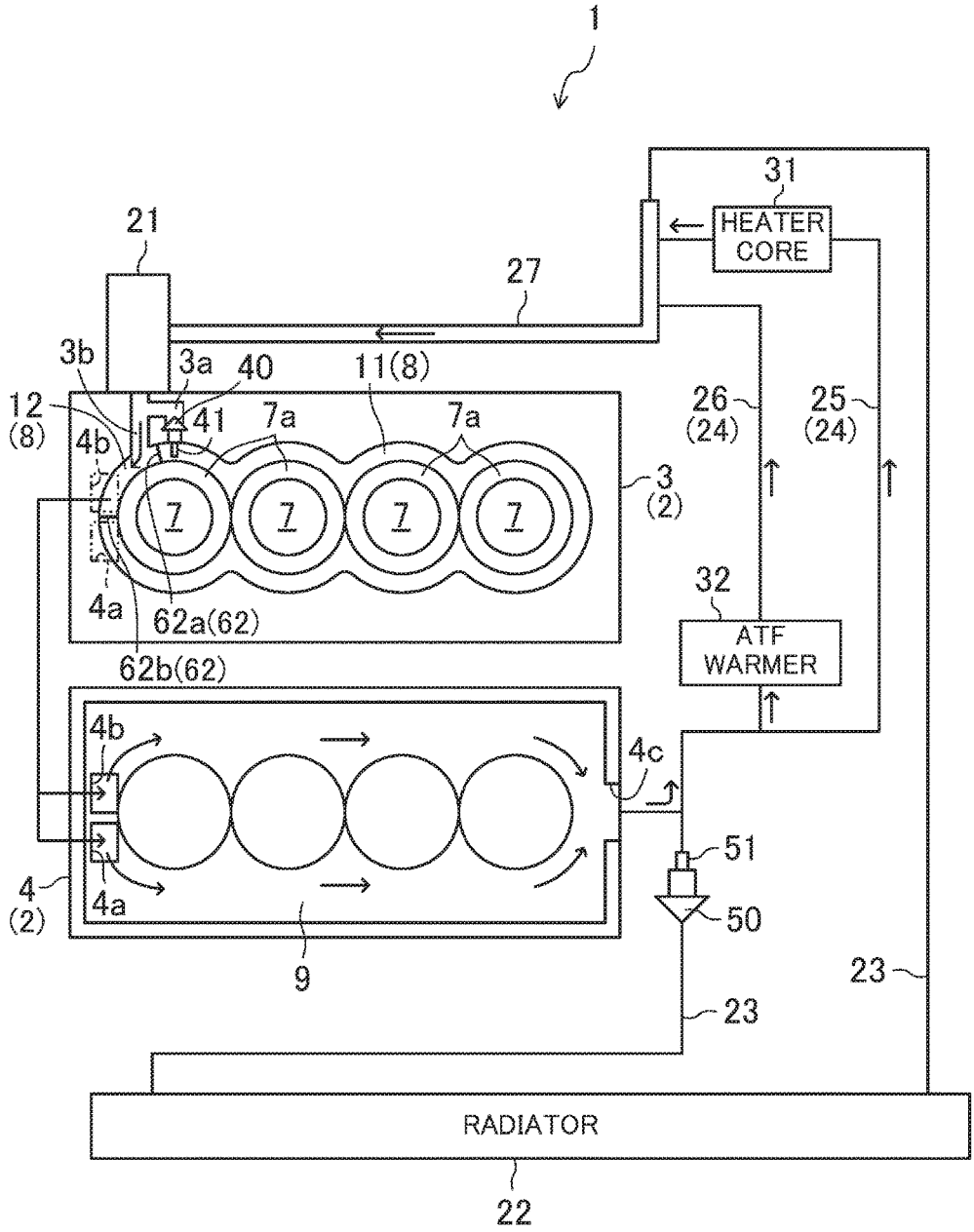
FIG. 7 illustrates the flow of the cooling liquid when first and second thermostatic valves are closed.
Figure 8:
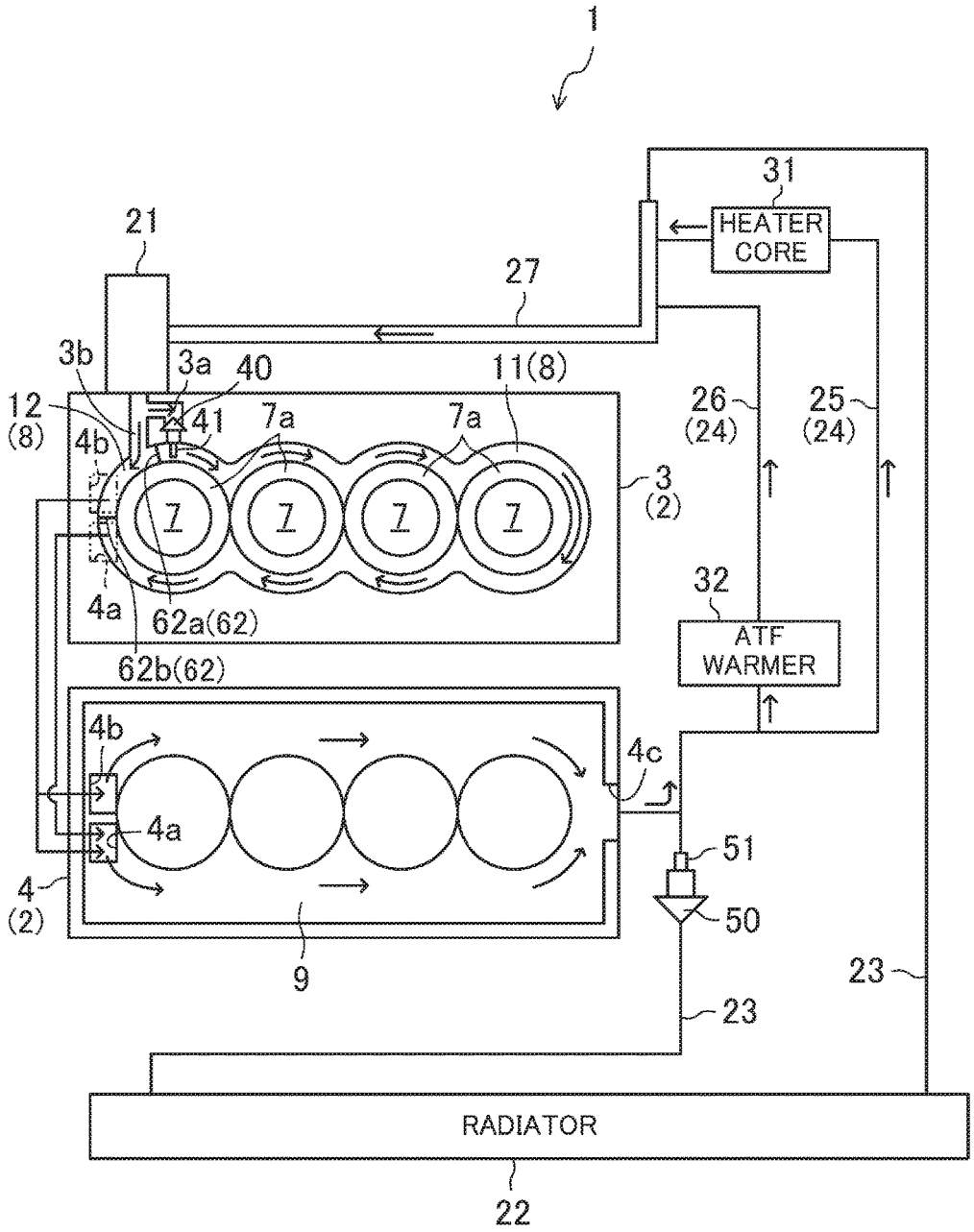
FIG. 8 illustrates the flow of the cooling liquid when the first thermostatic valve is opened and the second thermostatic valve is closed.
Figure 9:
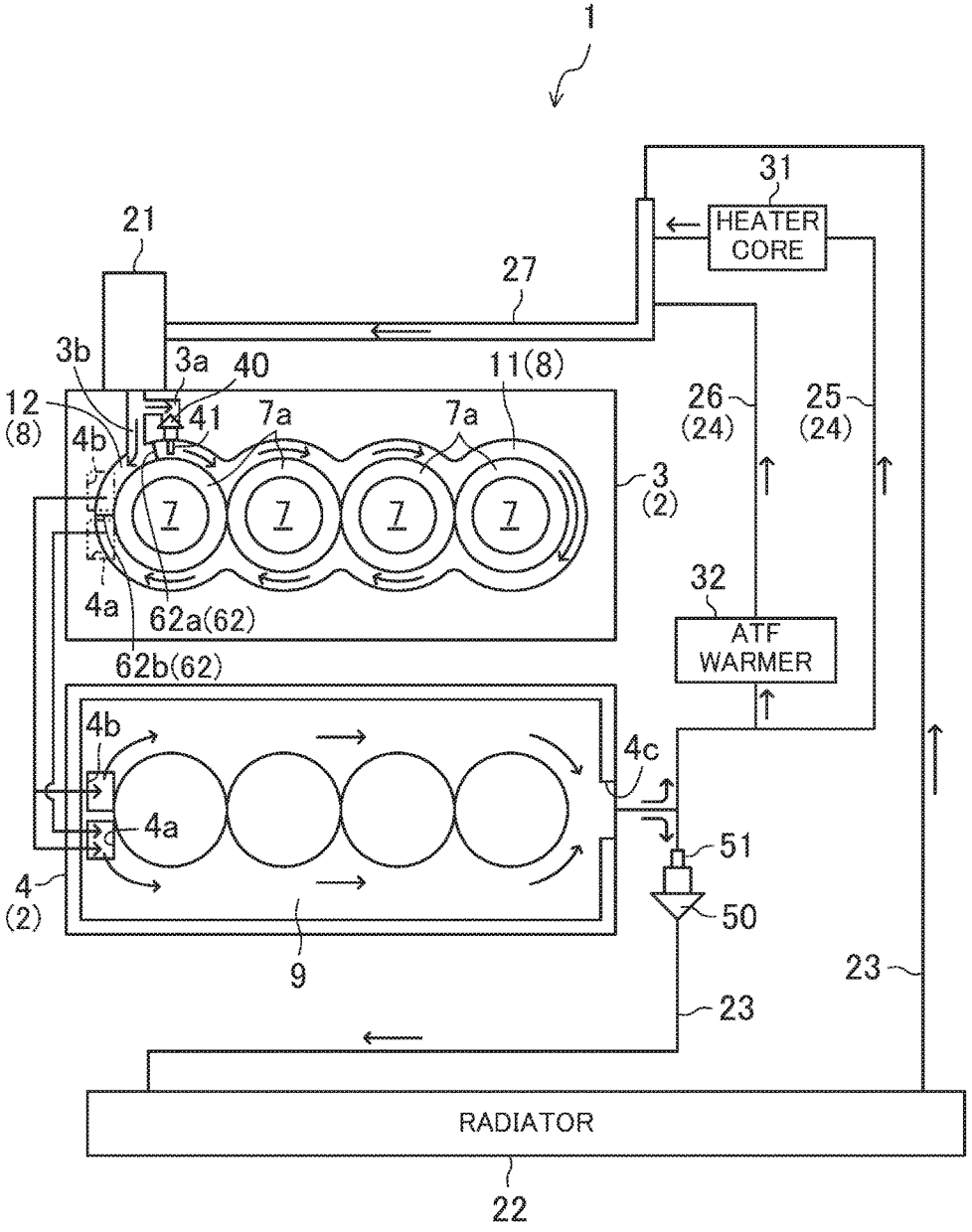
FIG. 9 illustrates the flow of the cooling liquid when the first and second thermostatic valves are opened.

As illustrated in FIGS. 2 and 3, a resin-made, water jacket spacer 61 having the same or similar shape as/to the block-side water jacket 8 when viewed from the cylinder head 4 is disposed inside the block-side water jacket 8. This water jacket spacer 61 partitions the block-side water jacket 8 into the block cooling passage 11 and the bypass passage 12 in the circumferential direction of the block-side water jacket 8. Specifically, the water jacket spacer 61 (the inside of the block-side water jacket 8) is provided with two partitions 62 partitioning the block-side water jacket 8 into the block cooling passage 11 and the bypass passage 12 in the circumferential direction of the block-side water jacket 8. Both ends of each partition 62 closer to and away from the cylinder 7 are provided with a sealing member, which is not illustrated. The divided portions of the block-side water jacket 8 in its circumferential direction (the block cooling passage 11 and the bypass passage 12) partitioned by the partitions 62 do not communicate with each other, and this limits the circulation of the cooling liquid between the divided portions of the block-side water jacket 8 in its circumferential direction. Here, to differentiate the two partitions 62 from each other, the partition 62 separating the upstream end of the block cooling passage 11 and the bypass passage 12 from each other is referred to as "upstream-side partition 62*a*," and the partition 62 separating the downstream end of the block cooling passage 11 and the bypass passage 12 from each other is referred to as "downstream-side partition 62*b*." FIG. 1 generally illustrates only the upstream-side partition 62*a* and the downstream-side partition 62*b* in the block-side water jacket 8 (each of FIGS. 7-9 illustrates them in the same or similar manner).

The downstream-side partition 62*b* is provided in the block-side water jacket 8 at a portion between the first and second inlets 4*a* and 4*b*, and separates a downstream end of the block cooling passage 11 and the bypass passage 12 from each other in the circumferential direction of the block-side water jacket 8.

The upstream-side partition 62*a* is provided at the boundary between the upstream end of the block cooling passage 11 and the bypass passage 12 in the block-side water jacket 8 (a portion between a portion where the downstream end of the cooling-liquid introducing passage 3*a* is connected to, and a portion where the downstream end of the branch passage 3*b* is connected to). The upstream-side partition 62*a* functions as a separating wall which allows the cooling-liquid from the cooling-liquid introducing passage 3*a* and the cooling-liquid from the branch passage 3*b* (the cooling-liquid introducing passage in the present disclosure) to flow into the block cooling passage 11 and the bypass passage 12, respectively. As a result, the cooling liquid that has flowed into the block cooling passage 11 from the cooling-liquid introducing passage 3*a* flows in the block cooling passage 11 without flowing into the bypass passage 12, and the cooling liquid that has flowed into the bypass passage 12 from the cooling-liquid introducing passage 3*a* through the branch passage 3*b* flows in the bypass passage 12 without flowing into the block cooling passage 11.

A step 63 is formed on the internal surface of the water jacket spacer 61 facing the block cooling passage 11 at a middle portion in the axis direction of the cylinder 7. This step 63 provides a space between the cylinder 7 (the cylinder bore wall 7*a*) and an upward extending portion 64 extending upward (toward the cylinder head 4) from the step 63 of the water jacket spacer 61. This space constitutes the block cooling passage 11. In other words, the step 63 and the upward extending portion 64 of the water jacket spacer 61 function as a cooling passage forming portion 65 for forming the block cooling passage 11. Basically, no cooling liquid flows in the block-side water jacket 8 under the step 63 (a portion away from the cylinder head 4). In this way, the cooling passage forming portion 65 forms the block cooling passage 11 between the cylinders 7 and the water jacket spacer 61 at at least a portion closer to the cylinder head 4. Such a block cooling passage 11 allows for, after the thermostatic valve 40 is opened, effectively cooling a portion of the cylinder 7 (the cylinder bore wall 7*a*), the portion being closer to the cylinder head 4, being to reach a high temperature, and corresponding to a combustion chamber.

An introduction opening 66 is formed in the water jacket spacer 61 at a portion closer to the upstream-side partition 62*a*, and allows the cooling-liquid introducing passage 3*a* to communicate with the block cooling passage 11. That is to say, the cooling-liquid introducing passage 3*a* is connected to a portion of the block cooling passage 11 closer to the upstream-side partition 62*a*.

Figure 4:
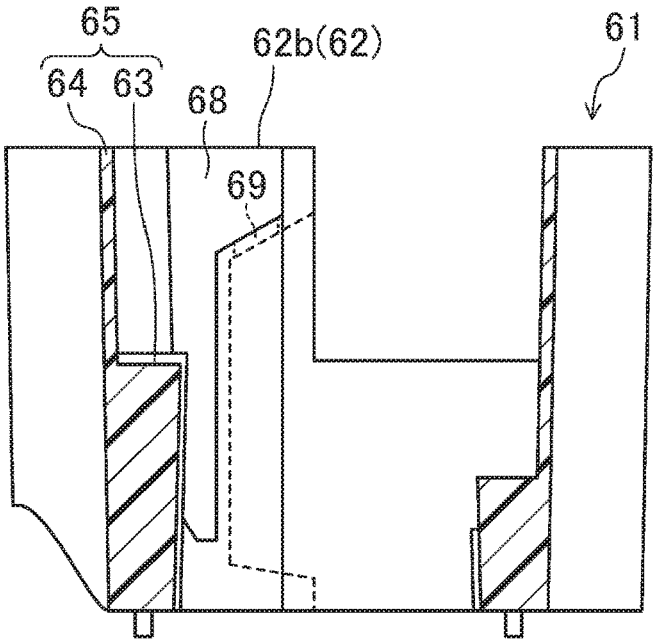
FIG. 4 is a cross-sectional view taken along the line IV-IV of FIG. 3.
Figure 5:
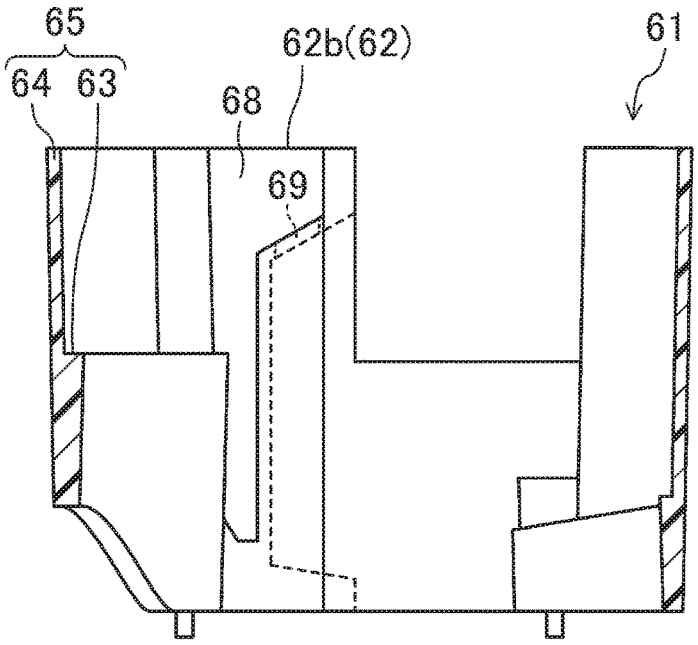
FIG. 5 is a cross-sectional view taken along the line V-V of FIG. 3.
Figure 6:
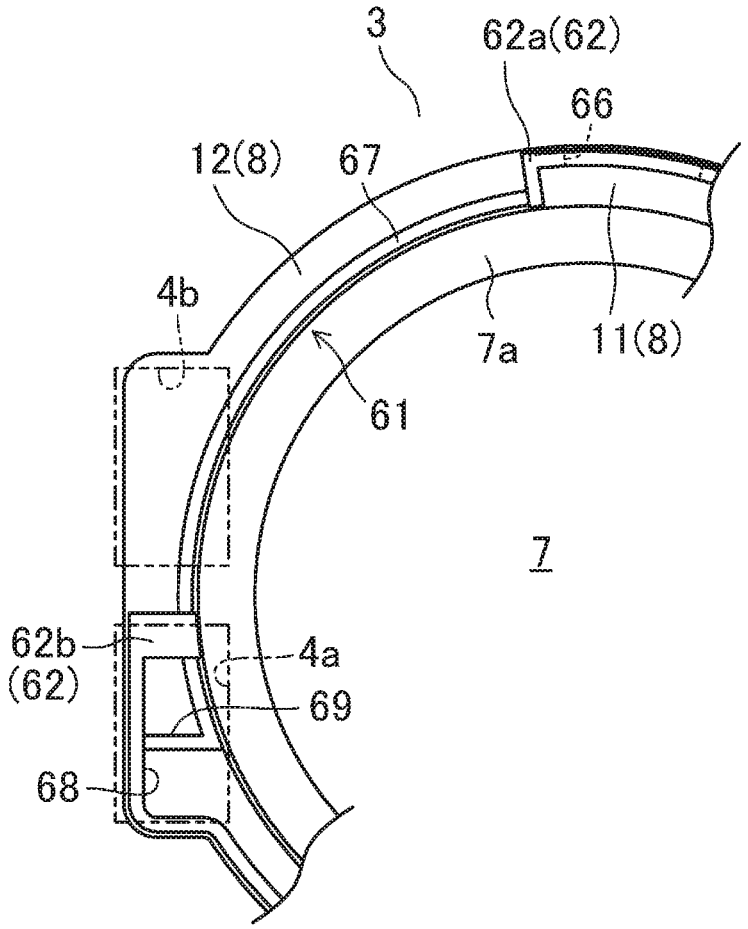
FIG. 6 illustrates a portion on the vehicle's right side of the block-side water jacket in which a water jacket spacer is disposed, viewed from above the cylinder block.

The introduction opening 66 is disposed in a lower portion of the water jacket spacer 61, and no step 63 is formed under the introduction opening 66. The step 63 is formed in a region ranging from a portion close to the upstream end of the block cooling passage 11 (a portion immediately downstream of the introduction opening 66) to a portion close to the downstream end of the block cooling passage 11 (a recess 68, which will be described later). The step 63 is inclined upward toward the downstream end such that the closer to the downstream end a point of the step 63 is, the closer to the top (to the cylinder head 4) the point is. Thus, as illustrated in FIGS. 4 and 5, the height of the step 63 in its vertical direction (the axis direction of the cylinder 7) differs between the front and rear sides of the same cylinder 7*a*. That is, the step 63 on the vehicle's front side (the left side in FIGS. 4 and 5), which corresponds to the downstream side, is higher than that on the vehicle's rear side (the right side in FIGS. 4 and 5), which corresponds to the upstream side.

As illustrated in FIG. 2, the temperature sensing element 41 of the thermostatic valve 40 passes through the introduction opening 66 and is disposed in the block cooling passage 11. In this way, the temperature sensing element 41 is disposed near the cylinder 7 (the cylinder bore wall 7*a*) in the block cooling passage 11.

The temperature sensing element 41 of the thermostatic valve 40 is disposed near the upstream-side partition 62*a* in the block cooling passage 11. This upstream-side partition 62*a* suppresses the flow or convection of the cooling liquid around the temperature sensing element 41 in the block cooling passage 11 even if the vehicle is accelerated or decelerated or the engine 2 vibrates in the closed state of the thermostatic valve 40. The upstream-side partition 62*a* thus also functions as a flow suppressing portion suppressing the flow of the cooling liquid near the temperature sensing element 41 in the block-side water jacket 8 (the block cooling passage 11) during the closed state of the thermostatic valve 40.

The water jacket spacer 61 has a coupling portion 67 in a position corresponding to the bypass passage 12. The coupling portion 67 couples the lower portions of the partitions 62 with each other to allow the water jacket spacer 61 to have a ring shape to maintain the shape of the portion of the water jacket spacer 61 corresponding to the block cooling passage 11. This coupling portion 67 is not intended to form the bypass passage 12, particularly. The bypass passage 12 is comprised of the wall of the block-side water jacket 8, the cylinder bore wall 7*a*, and the two partitions 62. The branch passage 3*b* is connected to the lower portion of the bypass passage 12, and the second inlet 4*b* is provided in the upper portion of the bypass passage 12. The cooling liquid that has flowed from the branch passage 3*b* thus flows in the bypass passage 12 from the lower side to the upper side of the bypass passage 12, and flows into the head-side water jacket 9 via the second inlet 4*b*.

As illustrated in FIGS. 3-6, the upper portion of the downstream-side partition 62*b* in the water jacket spacer 61 protrudes toward the bypass passage 12, and the recess 68 that is the downstream end of the block cooling passage 11 is formed inside this protruding portion. The first inlet 4*a* is disposed over the recess 68. In the lower end of the protruding portion of the downstream-side partition 62*b*, a through hole 69 allowing the inside and outside of the water jacket spacer 61 to communicate with each other is formed so as to extend in the vertical direction. This through hole 69 allows the bypass passage 12 and the recess 68 to communicate with each other.

A large part of the cooling liquid that has flowed from the branch passage 3*b* passes through the bypass passage 12 and flows into the head-side water jacket 9 via the second inlet 4*b*, but part of the cooling liquid passing through the bypass passage 12 enters the recess 68 via the through hole 69 from the bypass passage 12. This cooling liquid that has passed through the through hole 69 is directed to the first inlet 4*a* to flow into the head-side water jacket 9 via this first inlet 4*a*. This flow of the cooling liquid is relatively strong, and the cooling liquid that has flowed in the block cooling passage 11 is sucked into this flow to flow into the head-side water jacket 9 via the recess 68 and the first inlet 4*a*. This accelerates the inflow of the cooling liquid from the block cooling passage 11 into the head-side water jacket 9. As can be seen, the through hole 69 corresponds to an adjustment hole which makes part of the cooling liquid passing through the bypass passage 12 directed to the first inlet 4*a*.

If no through hole 69 is formed, no cooling liquid flows in the block cooling passage 11 and no cooling liquid flows into the head-side water jacket 9 via the first inlet 4*a* during the closed state of the first thermostatic valve 40. As a result, the cooling liquid that has flowed into the head-side water jacket 9 via the second inlet 4*b* from the bypass passage 12 may flow into the block cooling passage 11 via the first inlet 4*a* since this flow into the head-side water jacket 9 is strong. However, in this example embodiment, even if no cooling liquid flows in the block cooling passage 11, part of the cooling liquid passing through the bypass passage 12 flows into the head-side water jacket 9 via the through hole 69, the recess 68, and the first inlet 4*a*. As a result, the cooling liquid that has flowed into the head-side water jacket 9 via the second inlet 4*b* from the bypass passage 12 does not flow into the block cooling passage 11 via the first inlet 4*a*.

Next, the operation of the cooling system 1 will be described.

When the temperature of the cooling liquid contacting the temperature sensing element 41 is lower than the first predetermined temperature, as in a cold state immediately after the start of the engine 2 (during warm-up operation), the thermostatic valve 40 is closed. At this time, the temperature of the cooling-liquid contacting the temperature sensing element 51 is lower than the second predetermined temperature, and the second thermostatic valve 50 is also closed.

As a result, as illustrated in FIG. 7, the cooling liquid from the water pump 21 is not introduced in the block cooling passage 11, and passes through the branch passage 3*b* and the bypass passage 12 to flow into the head-side water jacket 9 via the second inlet 4*b*. Part of the cooling liquid passing through the bypass passage 12 flows into the head-side water jacket 9 via the through hole 69, the recess 68, and the first inlet 4*a*. This allows for preventing the cooling liquid that has flowed into the head-side water jacket 9 via the second inlet 4*b* from the bypass passage 12, as described above, from flowing into the block cooling passage 11 via the first inlet 4*a*.

In this way, in the cold state of the engine 2, preventing the cooling liquid from flowing into the block cooling passage 11 allows for accelerating the warm-up of the engine 2.

The cooling liquid that has flowed into the head-side water jacket 9 via the first and second inlets 4*a* and 4*b* flows through the cylinder head 4 from the one side to the other side in the cylinder-line direction, and flows out of the cylinder head 4 via the outlet 4*c*.

Since the second thermostatic valve 50 is closed, the cooling liquid that has flowed out of the outlet 4*c* does not flow in the radiator passage 23 and returns to the water pump 21 through the radiator bypass passage 24.

The thermostatic valve 40 is opened when the temperature of the engine 2 increases and the temperature of the cooling liquid contacting the temperature sensing element 41 reaches the first predetermined temperature. The temperature sensing element 41 of the thermostatic valve 40 is disposed near the cylinder 7 and the upstream-side partition 62*a* in the block cooling passage 11. This allows the temperature sensing element 41 to sense the temperature of the cooling liquid near the cylinder 7 even if the vehicle is accelerated or decelerated or the engine 2 vibrates. As a result, the thermostatic valve 40 can be opened or closed in an appropriate manner according to the temperature of the engine 2.

When the thermostatic valve 40 is opened, the cooling liquid from the water pump 21 flows not only in the branch passage 3*b* and the bypass passage 12 but also in the block cooling passage 11, as illustrated in FIG. 8. This allows the cooling liquid to flow in the head-side water jacket 9 not only from the block cooling passage 11 via the recess 68 and the first inlet 4*a*, but also from the bypass passage 12 via the second inlet 4*b*. As described above, part of the cooling liquid passing through the bypass passage 12 passes through the through hole 69 and the recess 68 from the bypass passage 12 and flows into the head-side water jacket 9 via the first inlet 4*a*. The cooling liquid that has flowed in the block cooling passage 11 is thus sucked into the above flow into the head-side water jacket 9 and flows into the head-side water jacket 9 via the recess 68 and the first inlet 4*a*. This accelerates the inflow of the cooling liquid from the block cooling passage 11 into the head-side water jacket 9.

When the thermostatic valve 40 is just opened from the close state, the temperature of the cooling liquid contacting the temperature sensing element 51 does not yet reach the second predetermined temperature, and the second thermostatic valve 50 remains closed. The cooling liquid that has flowed out of the outlet 4*c* does not flow in the radiator passage 23 and returns to the water pump 21 through the radiator bypass passage 24.

When the temperature of the engine 2 further increases and the engine 2 is warmed up, the temperature of the cooling liquid contacting the temperature sensing element 51 reaches the second predetermined temperature. As a result, the thermostatic valve 50 is also opened. This allows the cooling liquid that has flowed out of the outlet 4*c* flows into the radiator passage 23 and the radiator bypass passage 24, as illustrated in FIG. 9. The cooling liquid that has flowed in the radiator bypass passage 24 exchanges heat with air outside the vehicle in the radiator 22, and then, passes through the return passage 27 to return to the water pump 21. When the cooling liquid from the water pump 21 flows into the block cooling passage 11, the cooling passage forming portion 65 allows for effectively cooling a portion of the cylinder 7, the portion being closer to the cylinder head 4, being to reach a high temperature, and corresponding to a combustion chamber.

According to the example embodiment, the downstream-side partition 62*b* is provided with the through hole 69 constituting an adjustment hole which makes part of the cooling liquid passing through the bypass passage 12 directed to the first the first inlet 4*a*. This allows the part of the cooling liquid passing through the bypass passage 12 to pass through the through hole 69 to flow into the head-side water jacket 9 via the first inlet 4*a* even if no cooling liquid flows in the block cooling passage 11 during the cold state of the engine 2. This allows for preventing the cooling liquid that has flowed into the head-side water jacket 9 via the second inlet 4*b* from the bypass passage 12 as described above from flowing into the block-side water jacket 8 (the block cooling passage 11) via the first inlet 4*a*. This thus allows for effectively accelerating warm-up of the engine 2. The flow of the cooling liquid flowing into the head-side water jacket 9 via the through hole 69 and the first inlet 4*a* is relatively strong. Thus, during the warm state of the engine 2, the cooling liquid that has flowed in the block cooling passage 11 is sucked into this flow to flow into the head-side water jacket 9 via the first inlet 4*a*. This can accelerate the inflow of the cooling liquid from the block cooling passage 11 into the head-side water jacket 9. This thus can accelerate cooling of the cylinders 7.

The present disclosure should not be limited to the foregoing embodiment, and various changes and modifications may be made without departing from the scope of the claims.

For example, in the above embodiment, the water jacket spacer 61 is disposed inside the block-side water jacket 8. However, this water jacket spacer 61 does not have to be disposed. If no water jacket spacer 61 is disposed, the partition or the separating wall may be configured as a dedicated member or the cylinder block 3 itself.

The example embodiment described above is provided by way of illustration only and should not be construed to limit the present disclosure. The scope of the present disclosure should be measured solely by reference to the claims. All the modifications and changes within an equivalent scope of the claims fall within the scope of the present disclosure.

What is claimed is:

1. An engine cooling system comprising:

a block-side water jacket provided in a cylinder block of an engine and surrounding one or more cylinders; and a head-side water jacket provided in a cylinder head of the engine, wherein the cooling system is configured to supply a cooling liquid from a water pump to the block-side water jacket and the head-side water jacket through a cooling-liquid introducing passage, one end of the cylinder head is provided with first and second communication holes aligned in a circumferential direction of the block-side water jacket and allowing the block-side water jacket and the head-side water jacket to communicate with each other, the block-side water jacket is divided into a block cooling passage and a bypass passage in the circumferential direction of the block-side water jacket, the block cooling passage introducing the cooling liquid from the cooling-liquid introducing passage to allow the cooling liquid to flow in the block cooling passage such that the cooling liquid substantially circles around the cylinders, and then, allowing the cooling liquid to flow into the head-side water jacket via the first communication hole, and the bypass passage allowing the cooling liquid from the cooling-liquid introducing passage to flow toward a side away from the block cooling passage in the circumferential direction and to flow into the head-side water jacket via the second communication hole, the engine cooling system further comprises:

a separating wall separating an upstream end of the block cooling passage from the bypass passage, and provided with an introduction opening for allowing the block cooling passage to communicate with the cooling-liquid introducing passage;

a valve configured prohibiting introduction of the cooling liquid from the cooling-liquid introducing passage into the block cooling passage via the introduction opening in a situation where a temperature of the cooling liquid in the cooling-liquid introducing passage is lower than a predetermined temperature; and a partition provided in the block-side water jacket at a portion between the first and second communication holes, and separating a downstream end of the block cooling passage and the bypass passage from each other in the circumferential direction of the block-side water jacket, and the partition is provided with an adjustment hole which makes a flow of part of the cooling liquid passing through the bypass passage directed to the first communication hole.

2. The engine cooling system of claim 1, further comprising a water jacket spacer disposed inside the block-side water jacket, wherein the partition provided with the adjustment hole and the separating wall are formed in the water jacket spacer.

3. An engine cooling system comprising:

a block-side water jacket provided in a cylinder block of an engine and surrounding one or more cylinders;

a head-side water jacket provided in a cylinder head of the engine; and a water jacket spacer disposed inside the block-side water jacket, and having a same or similar shape as or to the block-side water jacket when viewed from the cylinder head, wherein the cooling system is configured to supply a cooling liquid from a water pump to the block-side water jacket and the head-side water jacket via a cooling-liquid introducing passage, one end of the cylinder head is provided with first and second communication holes aligned in a circumferential direction of the block-side water jacket and allowing the block-side water jacket and the head-side water jacket to communicate with each other, a block cooling passage is formed in an inner circumference of the water jacket spacer in the block-side water jacket, the block cooling passage, in a circumferential direction of the block-side water jacket, introducing the cooling liquid from the cooling-liquid introducing passage to allow the cooling liquid to flow in the block cooling passage such that the cooling liquid substantially circles around the cylinders, and then, allowing the cooling liquid to flow into the head-side water jacket via the first communication hole, a bypass passage is formed in an outer circumference of the water jacket spacer in the block-side water jacket, the bypass passage introducing the cooling liquid from the cooling-liquid introducing passage via a branch passage branched from the cooling-liquid introducing passage, allowing the cooling liquid to flow toward a side away from the block cooling passage in the circumferential direction and to flow into the head-side water jacket via the second communication hole, the engine cooling system further comprises:

a separating wall separating an upstream end of the block cooling passage from the bypass passage, and provided with an introduction opening for allowing the block cooling passage to communicate with the cooling-liquid introducing passage;

a valve provided downstream of a portion of the cooling-liquid introducing passage where the branch passage is branched, the valve prohibiting introduction of the cooling liquid from the cooling-liquid introducing passage into the block cooling passage via the introduction opening in a situation where a temperature of the cooling liquid in the cooling-liquid introducing passage is lower than a predetermined temperature; and a partition provided in the block-side water jacket at a portion between the first and second communication holes, and separating a downstream end of the block cooling passage and the bypass passage from each other in the circumferential direction of the block-side water jacket, and the partition is provided with an adjustment hole which makes a flow of part of the cooling liquid passing through the bypass passage directed to the first communication hole, and the separating wall and the partition are formed in the water jacket spacer.

* * * * *